US009139916B2

(12) United States Patent
Klein

(10) Patent No.: US 9,139,916 B2
(45) Date of Patent: Sep. 22, 2015

(54) METHOD AND DEVICE FOR RECYCLING METAL PICKLING BATHS

(75) Inventor: Klaus Klein, Osterode/Harz (DE)

(73) Assignee: CMI UVK GMBH, Montabaur (DE)

( * ) Notice: Subject to any disclaimer, the term of this patent is extended or adjusted under 35 U.S.C. 154(b) by 1828 days.

(21) Appl. No.: 10/520,723

(22) PCT Filed: Jul. 9, 2003

(86) PCT No.: PCT/EP03/07417

§ 371 (c)(1),
(2), (4) Date: Feb. 10, 2006

(87) PCT Pub. No.: WO2004/007801

PCT Pub. Date: Jan. 22, 2004

(65) Prior Publication Data

US 2006/0201822 A1 Sep. 14, 2006

(30) Foreign Application Priority Data

Jul. 10, 2002 (DE) ..... 102 31 308

(51) Int. Cl.

| | |
|---|---|
| ***C02F 9/00*** | (2006.01) |
| ***C02F 1/02*** | (2006.01) |
| ***C23G 1/36*** | (2006.01) |

(52) U.S. Cl.

CPC ..... *C23G 1/36* (2013.01)

(58) Field of Classification Search

CPC ..... C02F 9/00; C02F 1/02; C02F 2201/46185
USPC ..... 205/588, 687, 742, 749
See application file for complete search history.

(56) References Cited

U.S. PATENT DOCUMENTS

| | | | | |
|---|---|---|---|---|
| 4,655,928 | A | 4/1987 | Milton et al. | |
| 5,500,098 | A * | 3/1996 | Brown et al. | 203/13 |
| 6,375,915 | B1 | 4/2002 | Barhold et al. | |
| 6,846,418 | B2 * | 1/2005 | Starcevic | 210/651 |

FOREIGN PATENT DOCUMENTS

| | | |
|---|---|---|
| DE | 3825857 | 2/1990 |
| DE | 3906791 | 9/1990 |

(Continued)

OTHER PUBLICATIONS

Kladnig "Industrielle Oxidrohstoffe" Sprechsaal (1991) vol. 124 No. 11/12, pp. 748-754.

(Continued)

*Primary Examiner* — Zulmariam Mendez
(74) *Attorney, Agent, or Firm* — Lucas & Mercanti, LLP; Klaus P. Stoffel

(57) ABSTRACT

The invention relates to a method for recycling metal pickling baths, including rinsing baths and air washers. Said method is characterized in that a) before the recycling process, free acids in the liquid waste flows to be treated are converted into a metallic salt form, b) water is separated from the largely acid-free metallic salt solution produced in order to obtain a concentrated metal salt solution, and c) the concentrated metal salt solution is subjected to a thermal method in order to obtain metal oxides and free acids. The invention also relates to a corresponding device. The inventive method and device enable the degree of acid recovery and also the production of metal oxides to be significantly increased, with lower operating costs.

12 Claims, 3 Drawing Sheets

(56) References Cited

FOREIGN PATENT DOCUMENTS

| | | | | | |
|---|---|---|---|---|---|
| DE | 69320888 | T2 | | 2/1999 | |
| DE | 19740164 | | | 3/1999 | |
| EP | 0296147 | | | 12/1988 | |
| EP | 0398863 | | | 11/1990 | |
| EP | 0578537 | | * | 1/1994 | ..... C23G 1/36 |
| EP | 0843025 | | | 5/1998 | |
| EP | 1310581 | | | 5/2003 | |
| ES | 2121068 | T3 | | 11/1998 | |
| ES | 2330902 | | | 8/2006 | |
| WO | 9627554 | | | 9/1996 | |

OTHER PUBLICATIONS

Montens "Neue Verfahren zur Behandlung und Vermei-dung v. Beizereiabwässern" Stahl+Eisen (1964), Heft 27, pp. 1841-1849.

Frei "Abwasseraufbereitung in der Oberllächentechnik" Metalloberfläche (1997) No. 10, pp. 754-756.

Prospekt der Steuler Industriewerke GmbH "Liquid Waste Treatment", 1998.

Lipkin "Chemische und elektrochemische Bear-beitung von Stahlrohren" Metallurgija 1982, pp. 67-71.

* cited by examiner

METHOD AND DEVICE FOR RECYCLING METAL PICKLING BATHS

BACKGROUND OF THE INVENTION

Typical metal pickling baths are operated on the basis of nitric, hydrofluoric, and/or hydrochloric acids. In addition to the economic viewpoints, the problems of these pickles lie in an undesirably high quantity of nitrate in the waste water to be treated. Pickles having replacement acids for nitric acid, such as sulfuric acid with a greatly reduced proportion of nitric acid, are known for reducing this nitrate load, but they are extremely disadvantageous in regard to the pickling quality and capacity.

Furthermore, recycling systems for separating free acids and salts, such as acid retardation and diffusion dialysis, are used in order to reduce the nitrate load in the waste water by reclaiming the free acids and therefore also make the disposal of the waste acids more cost-effective. The savings in acids achievable therewith are considerable, but do not really solve the actual nitrate problem, since large quantities of nitrate-containing waste water are still produced by the nitrate salts. If acid recycling systems are used, the predominant wastewater load due to nitrate no longer comes from the pickle baths, but rather from the attached rinsing baths and air washers, which are not recycled.

A suggestion for processing used pickling acid comes from the teaching of DE 38 25 857 A1, for example, according to which the used pickling acid, having a specific iron content and material ratio of fluoride/iron, is to be adjusted using alkaline material to pH 4 to 6 while forming a crystalline precipitate and the liquid phase is to be evaporated until dry, possibly after separating the precipitate.

Furthermore, a method for preparing metal-containing waste pickles which contain nitric acid and hydrofluoric acid comes from the disclosure of DE 39 06 791 A1, in which the waste pickle is introduced into a dialysis cell, which is delimited by selectively permeable membranes and positioned between an electrode pair whose anode and cathode spaces contain sulfur.

A thermal method, the roasting method, offers the most complete recycling of the pickling bath concentrate. In this case, the pickling acids are evaporated together with the water and the metals are roasted to form oxides. The acid residues of the metal salts are reclaimed as free acids in the distillate of the roaster. Therefore, the pickling bath concentrate may be treated almost without wastewater and waste.

In the article "Industrielle Oxidrohstoffe—Herstellung nach dem Andritz-Ruthner-Sprührostverfahren [Industrial Oxide Raw Materials—Production According to the Andritz-Ruthner Spray Roasting Method]" by Dr. Wolfgang Kladnig, Sprechsaal, Vol. 124, Number 11/12, 1991, a method for the industrial production of oxide raw materials is described, in which a metal chloride solution is first produced by adding hydrochloric acid. The metal salt solution thus prepared is subsequently purified and subjected to pyrohydrolysis, in which the metal oxides to be extracted and hydrogen chloride gas form. While the metal oxides are subjected to still further purification steps, the hydrochloride gas is converted back into hydrochloric acid by using water. The hydrochloric acid thus obtained is used again for renewed production of a metal chloride solution.

A method for recycling metal pickling baths, in which the undesired compounds from the metal pickling baths, such as silicon, aluminum, and chromium compounds, are to be removed, is known from EP-A-O 578 537. For this purpose, scrap metal is added to the metal pickling baths to be purified in a first step, in order to neutralize the free acidity of the metal pickling baths, the neutralization having to be performed under a neutral gas atmosphere in order to prevent undesired secondary reactions of iron compounds contained in the metal pickling baths to form trivalent iron compounds. Subsequently, the solids contained in the neutralized metal pickling bath are filtered out. Because the acidity of the metal pickling bath is intentionally reduced, i.e., the pH value is increased, undesired compounds, such as silicon, aluminum, and chromium compounds, which dissolve at lower pH values, precipitate, through which the metal pickling bath may be purified of these compounds. Subsequently, the purified metal pickling bath is supplied back to the pickling process.

Thus, according to the related art according to EP 0 296 147 A1, a method for obtaining and/or reclaiming acids from metal-containing solutions of these acids is described, according to which the solutions are spray-roasted in a reactor at temperatures from 200 to 500° C. and subjected to subsequent absorption and condensation of the resulting gasses in columns at temperatures from 0 to 70° C.

However, the roasting method is energy-consuming, the energy consumption being directly proportional to the supply volume and approximately 100 $m^3$ natural gas being consumed per 1 $m^3$ supply volume. Since the roasting method evaporates water and acids to the same extent, the rinsing and exhaust air wastewater, which are diluted, may not be roasted directly. Because of the high proportion of water, the acid concentrations would be too small and/or the volume would be too large to return them to the pickling bath. The rinsing water must therefore still be treated in a wastewater system. Since the material load of this wastewater, above all the nitrates, may easily be 50% of the total nitric acid consumption, the roasting method per se, as it has been used until now, is not the comprehensive solution, especially in regard to the nitrate load of the wastewater.

The goal must therefore be to concentrate the strongly diluted wastewater from the rinsing and exhaust air washers enough that it may be introduced into the roast process. The concentration of the diluted wastewater has not been able to be implemented until now, however, since the technologies available are not usable. Thus, membrane technologies in the form of electrodialysis and reverse osmosis facilities could not be used because of the inadequate membrane strengths. Evaporation facilities are not usable because of the vapor volatility of nitric acid and hydrofluoric acid in the distillate. If free hydrofluoric and nitric acid are present in the supply to the evaporator, up to 50% of these free acids are found again in the distillate, so that usage of the distillate as rinsing water is not possible. The distillate, which now thus only contain 50% of the original nitrate load, must nonetheless be disposed of via the wastewater facility and the evaporator, up to 50% of these free acids are found again in the distillate, so that usage of the distillate as rinsing water is not possible. The distillate, which now therefore contains only 50% of the original nitrate load, must nonetheless be disposed of via the wastewater facility and would therefore again not comprehensively solve the nitrate problem in the wastewater.

SUMMARY OF THE INVENTION

The present invention is accordingly based on the object of avoiding the disadvantages described and refining the methods and devices known from the related art in such a way that, while maintaining the advantages, a cost-effective method for recycling metal pickling baths is provided. A method and/or a device is to be provided which allows metal pickles to be operated free of wastewater and waste as much as possible, in particular, the wastewater load of nitrates is to be as low as possible.

According to the present invention, the above object is achieved by a method for recycling metal pickling baths, including the associated rinsing baths and air washers, distinguished by a) converting the free acids present in the liquid waste streams to be treated into the metal salt form before recycling,
b) separating water from the largely acid-free metal salt solution obtained in order to obtain a concentrated metal salt solution, and
c) supplying the concentrated metal salt solution to a thermal method to obtain metal oxides and free acids.

Especially good results are achieved using the method according to the present invention when recycling steel pickling baths, particularly stainless steel pickling baths.

The object of the present invention is also a device for recycling metal pickling baths, including the associated rinsing baths and air washers, which has:

at least one system for converting the free acids present in the liquid waste streams to be treated into the metal salt form before recycling,
at least~one system for separating water from the metal salt solution obtained, which is as free of acids as possible, in order to obtain a concentrated metal salt solution, and
at least one system for thermal salt decomposition of the salt concentrate streams from the pickling baths and the rinsing to obtain metal oxides and free acids.

The method according to the present invention and/or the device according to the present invention thus disclose a way in which even typical pickling baths based on $HNO_3$/HF/HCl may avoid the disadvantages of vapor volatility arising due to these acids when using thermal methods and the diluted wastewater from the rinsing and the air washers may be evaporated. Therefore, the nitrate problem in the wastewater is solved and the roasting method is possible in a more cost-effective way.

The method and the device according to the present invention use typical components in such a way that operation without wastewater and waste may be maintained under cost-effective conditions. The last step, which determines the cost effectiveness because of the high energy consumption, is the thermal salt decomposition according to step c), like the roasting method. In this method, the liquid phases, such as water and acids, are evaporated and subsequently the vapor phase is condensed again and the acids are reclaimed at the same time. The metals are oxidized at high temperatures and accumulate as solids. The energy consumption and therefore the operating costs of the roaster are largely a function of the supply volume to the roaster and are approximately 1000 kWh and/or 100 $m^3$ natural gas per $m^3$ of supply. Therefore, the roasting method has the smallest possible supply volume for energy reasons (corresponding to a high metal content in the pickling bath), which is not always desirable for the pickling conditions, however. High metal content in the pickling baths causes lower pickling capacities and higher $NO_x$ losses in the exhaust air of the pickling baths and therefore a higher load of the air washers.

According to a preferred embodiment of the present invention, an evaporator, particularly one having mechanical exhaust vapor sealing, is used for reducing the supply volume to the roaster and therefore for especially cost-effective operation in step b). This type of evaporator has an energy consumption of only approximately 20-25 kWh per ton of supply. Each ton of water which the evaporator withdraws from the supply to the roaster saves energy costs of approximately 100 $m^3$ natural gas.

Furthermore, it is known that the exhaust air losses of the roaster, especially nitric acid in the form of $NO_x$, are notable and may move in the range from 10-15% of the supply quantity. Therefore, the smallest possible quantity of nitrate and/or nitric acid is supplied to the roaster. According to the present invention, in a preferred variation, a separating system for acids and salt is used for this purpose, such as retardation or diffusion dialysis, in order to keep the free acids out of the roaster. The free acids are conducted directly back into the pickling bath. Through the regeneration of the pickling bath concentrate, approximately 90% of the free acids are separated from the pickling bath solution and only approximately 10% are still supplied to the roaster. The $NO_x$, losses, in relation to the concentrate streams, are therefore only approximately 1% with regeneration, compared to 10% without regeneration. Comparable conditions apply for hydrofluoric acid, but the absolute values are lower, since hydrofluoric acid makes up only approximately 20% of the nitric acid concentration.

As already determined for the roaster, the free acids $HNO_3$ and HF are volatile during the evaporation and are found again in a high percentage in the distillate. If one attempts to transfer the acids 100% into the distillate in the roaster, it is desirable for as little acid to enter the distillate as possible when evaporating the rinsing water. This is not successful if free acids are present in the supply to the evaporator. The distillate obtained from an evaporator is no longer directly usable as rinsing water. Additional method steps, such as ion exchange loop facilities, would be necessary in order to allow usage of the distillate. The additional investments required strain cost effectiveness. Direct evaporation of rinsing water and wastewater from the air washers may therefore not be performed cost-effectively. For the same-reason, further evaporation of the pickling bath concentrate to save operating costs before roasting is not advantageous.

As already described for the roaster, the optimum operating condition for operation of an evaporator is the most extensive possible absence of free acids in the supply. Therefore, it is disadvantageous to supply pickling bath concentrate directly to the evaporator. A reduction of the free acids through a separation system, as described above, provides significant advantages, but may be improved further, since there are still sufficient residues of free acids in the salt solution, which contaminate the distillate of the evaporator. The direct supply of rinsing water to the evaporator also fails, since the evaporator lies in the range of the pickling bath concentration in regard to the concentrate (higher content of free acids)

The method according to the present invention achieves the objects described above in that, according to one embodiment of the present invention, the free acids in the supply to the evaporator are eliminated without the degree of acid reclamation by the roaster being impaired at the same time. According to the present invention, the degree of acid reclamation and also the extraction of metal oxides may surprisingly be significantly increased in this way while simultaneously lowering operating costs.

According to an especially preferred embodiment, the separation of the free acid from the recycling stream (pickling bath concentrate) is performed in two separate steps. Preferably, the pickling bath concentrate is treated in an acid regeneration system, such as acid retardation or diffusion dialysis. Acid retardation is built on an ion exchange method, in which a special resin absorbs the acid when charged, while the metal salt solution passes the resin bed without being influenced and leaves the system dissolved in water.

The free acids arising from the acid regeneration system preferably go back into the pickling bath, while a stream which is poorer in acid but richer in metal salts is collected for further treatment. The wastewater stream of the regeneration system may advantageously be mixed with the wastewater streams from the rinsing and the air washers. A stream which is low in free acid and has a moderate amount of metal salts, with a high proportion of water, arises.

Operation of the evaporator using the above-mentioned supply provides advantages, but it may be improved even further. The low proportion of free acids would concentrate during the evaporation process, a large part of the free acids reaching the distillate. The vapor volatility of the acids will only be suppressed and one will obtain an acid-free distillate which may be used again directly as rinsing water when the free acids are converted nearly completely into metal salts.

Typically, neutralization chemicals, such as sodium hydroxide solution, lime, etc., are used to convert the free acids. This simple and typical method is not advantageous for the method according to the present invention, since the metals sodium, calcium, etc. also reach the roaster, but are not desirable here. The method according to the present invention therefore preferably uses metal hydroxides, metal carbonates, or metal oxides having metals which may also be used in the pickling bath in step a).

In the way described above for joint evaporation of streams from the recycling system and the wastewaters from rinsing and air washers, a relatively large quantity of metal hydroxides are to be applied in order to eliminate the free acids. This large quantity must be supplied from the outside and therefore represents an additional logistical problem. Partial use of metal oxides which were previously generated in the roaster would be possible, but stresses cost effectiveness.

It is more cost-effective, as in an especially preferred embodiment of the method according to the present invention, to supply the rinsing water together with the exhaust air water to a separate treatment. The goal is to not introduce the acids from the rinsing and exhaust air water into the roaster loop. Through this measure, the quantity of free acids is drastically reduced before evaporation. Therefore, at this point the consumption of metals to convert the free acids is accordingly lowered and one no longer has to turn to external supply with metals.

The metal salt, such as metal hydroxide, used for converting the free acids, before the evaporation of the roaster concentrate, in step a), is preferably precipitated from the accumulated rinsing and exhaust air water under special conditions according to the method according to the present invention. A neutralization chemical which precipitates the metal but keeps the acid residues in solution is expediently used. Sodium hydroxide solution and potassium hydroxide solution are possible here, it having been shown that operating with potassium hydroxide solution is advantageous for the further treatment of the acid residues.

The metals are preferably precipitated out and filtered off as hydroxides through the neutralization of the rinsing and exhaust air water. The filter cakes obtained may then be advantageously introduced into a container having a stirrer before the evaporator for pickling bath concentrate, in order to convert the residues of the free acids from the recycling system for pickling bath concentrate into metal salts here.

For example, the water coming out of the neutralization system contains potassium fluoride and potassium nitrate in strongly diluted form. Disposal of this water stream via a wastewater system would in turn raise the nitrate load in the wastewater. The method according to the present invention or the device according to the present invention may accordingly preferably be used in order to decompose the neutral salts found in this stream into the pickling acids HF, $HNO_3$ and the neutralization chemical potassium hydroxide. For example, cation exchange and electrodialysis systems come into consideration for this purpose. The acids are then conducted back into the pickling bath and the potassium hydroxide solution is conducted into the neutralization system. The loop is thus closed and the rinsing and air washers are free of waste and wastewater.

Since the wastewater streams from rinsing and air washers comprise over 95% water it is preferable for separation of the water in step b) to occur before the salt decomposition according to step c), in order to thus generate a sufficiently high concentration of free acids and neutralization chemicals in the system for salt decomposition. For example, reverse osmosis systems and evaporators are available as system components for water separation. Since higher concentration rates are achieved using an evaporator, an evaporator system is preferred at this point.

A salt water stream without any free acids, having a pH value>8, for example, arises through the neutralization and precipitation of the metals. For the evaporation, this means that volatile acids are no longer present in this stream, the distillate generated has a high quality, and may be used again directly as rinsing water having VE quality (completely desalinated water having a pH value of approximately 7). A further advantage of this method is the low aggressiveness of the neutral water stream in relation to a stream having the metal salts, such as from the pickling concentrate. While the acid-free salt stream of the pickling bath concentrate expediently has a pH value of only approximately 2.5 to 3 and therefore is still extremely aggressive, the pH value of the neutralized rinsing water is preferably at pH 8 and is therefore not very aggressive. Consequences in the material selection for the particular system result from this, both for reverse osmosis and for an evaporator. While typical stainless steels, e.g., of quality 1.4571 and/or V4A, are sufficient for the stream having pH 8 for reasons of corrosion resistance, special high-alloy steels for system construction are to be used for the acid stream. Since the neutral stream typically requires a significantly larger evaporator, significant investment costs may be saved through the material selection by separate evaporator systems.

The advantages connected with the present invention are manifold. A method and/or a device is provided which allows metal pickles to be operated free of wastewater and waste as much as possible, the wastewater load of nitrates being as low as possible in particular. Simultaneously, the system for salt separation, such as a roasting method, may be operated more cost-effectively.

According to the present invention, a way is thus shown for even typical pickling baths based on $HNO_3$/HF to avoid the disadvantages of vapor volatility arising with these acids if thermal methods are used and to allow the diluted wastewater from the rinsing and air washers to be evaporated.

Due to the conversion of the free acids into metal salts in the reactor, no corrosion problems-arise in the concentrator, such as an evaporator, and less expensive stainless steels may be used in the construction. Through corresponding optimization, such as regulation of the volume streams, smaller dimensions may be used in the devices, such as a concentrator which is dimensioned smaller, which is connected to a significant reduction of the costs.

Furthermore, the present invention allows, through the regeneration, approximately 90% of the free acids to be separated from the pickling bath solution and only approximately 10% to still be supplied to the roaster, through which the $NO_x$ losses, in relation to the concentration stream, may be reduced to a very low level, approximately 1%, using the method according to the present invention.

As a result, according to the present invention the degree of acid reclamation and also the extraction of metal oxides may be significantly increased while simultaneously lowering operating costs.

In the following, the present invention will be described in detail on the basis of three examples, which are not to restrict the teaching according to the present invention. Further exemplary embodiments will be obvious to one skilled in the art in the framework of the disclosure according to the present invention.

DETAILED DESCRIPTION OF THE INVENTION

Example 1

Figure 1:
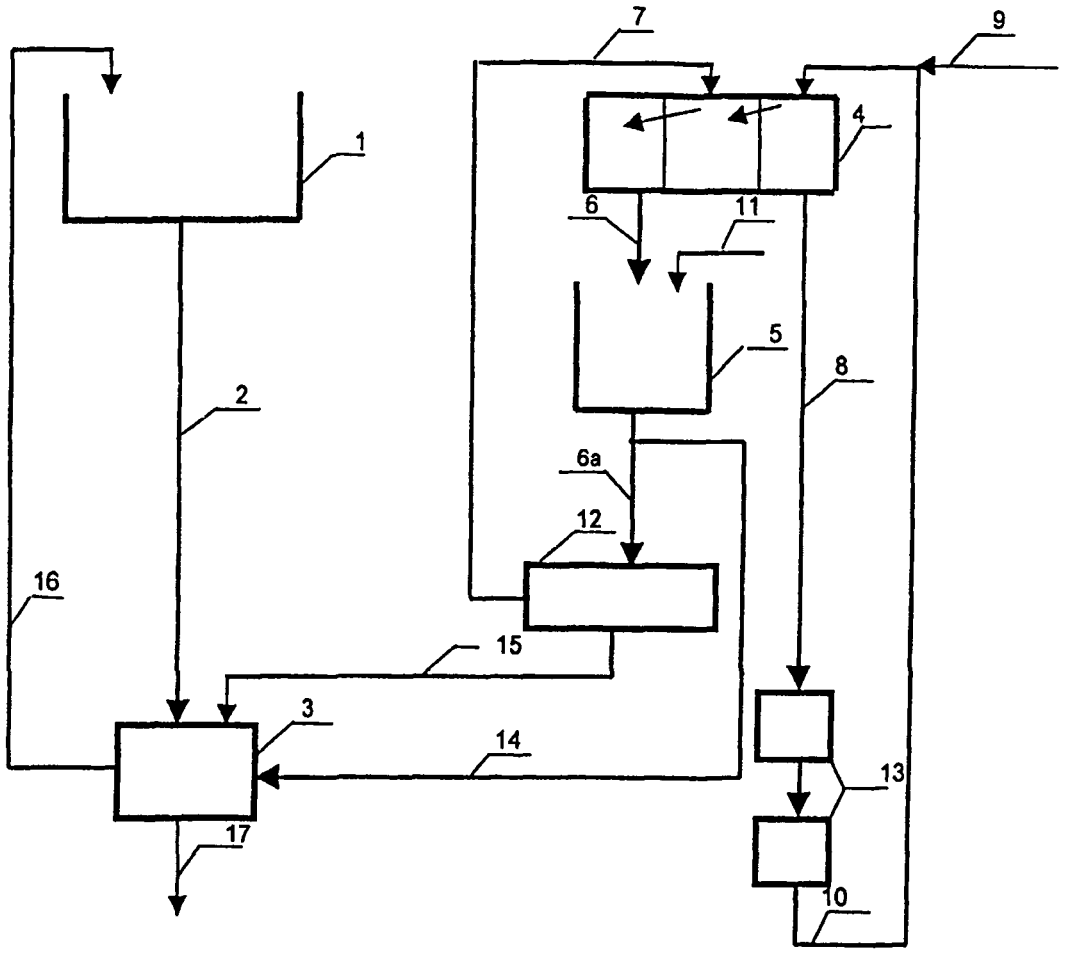
FIG. 1 shows a schematic representation of Example 1 of the invention.
Figure 2:
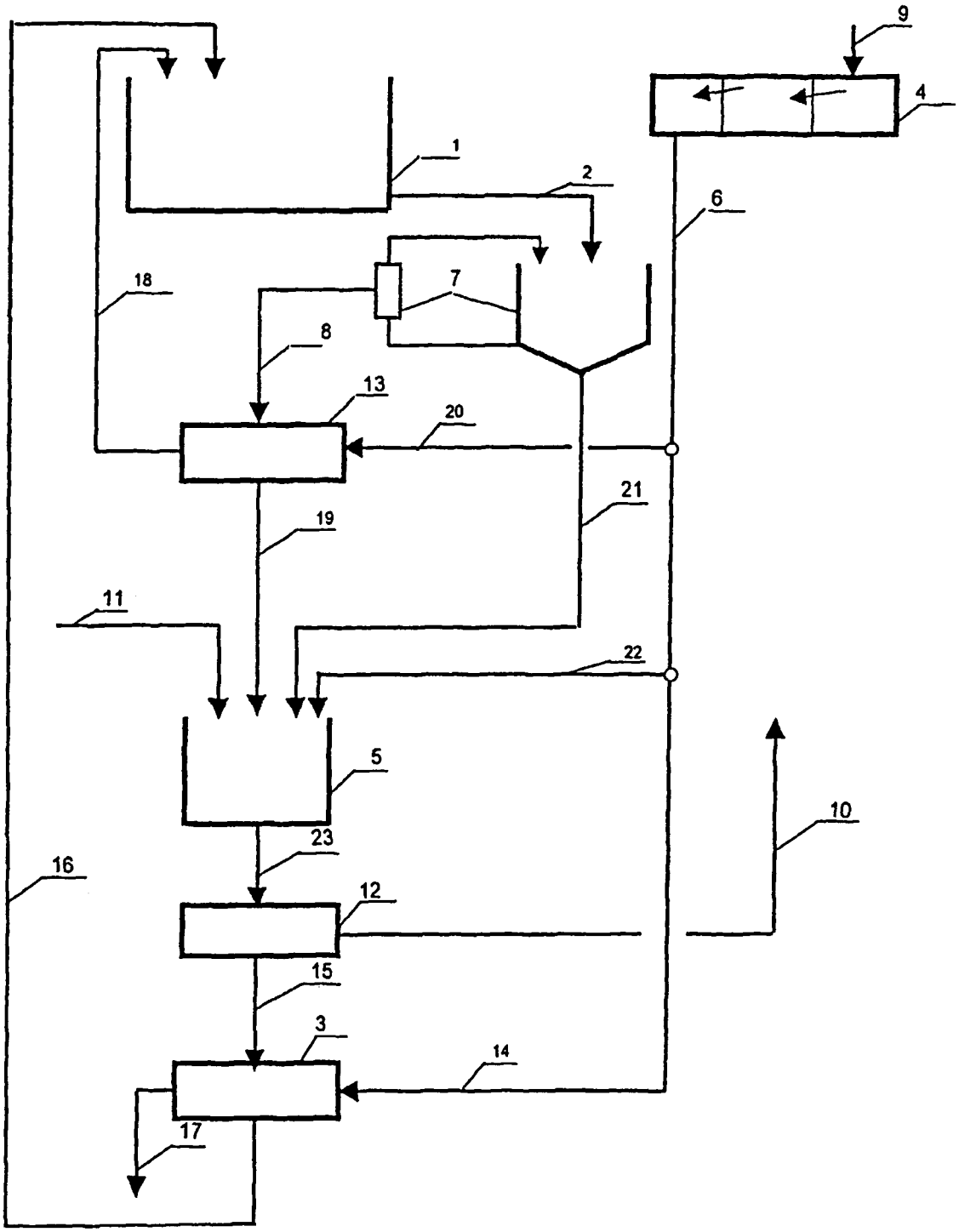
FIG. 2 shows a schematic representation of Example 2 of the invention.
Figure 3:
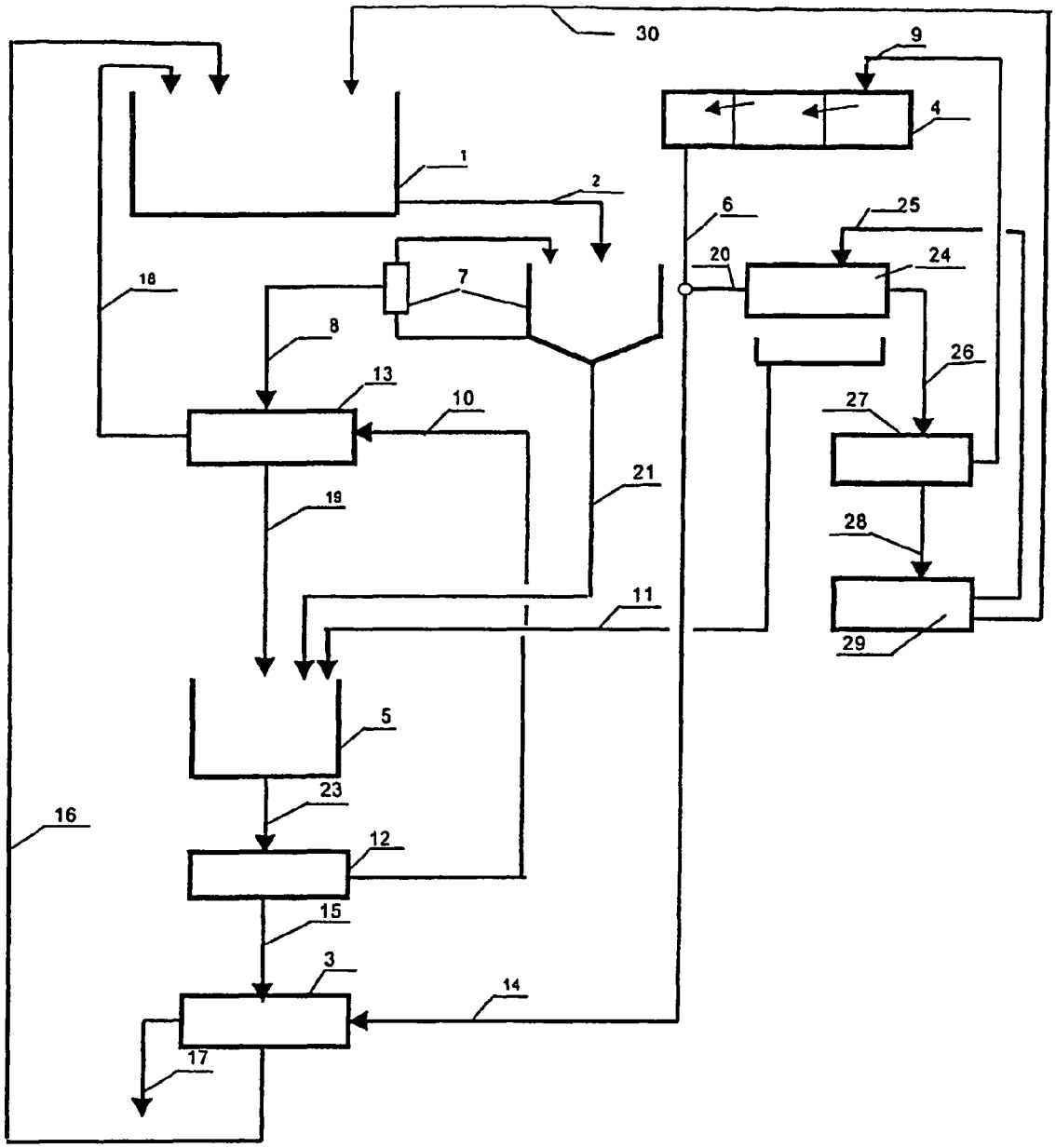
FIG. 3 shows a schematic representation of Example 3 of the invention.

FIG. 1 shows a pickling device (1) having an attached rinse (4). The typical regeneration system having roaster (3) was expanded with an evaporator system (12) for rinsing and exhaust air water. The volume stream (2) from the pickling bath (1) is to be approximately 3.5 $m^3$/hour and the volume stream (6) from the rinse is to be approximately 15 $m^3$/hour. These values apply for all 3 examples.

The pickling bath concentrate (2) is supplied directly to the roaster (3). Since the accumulated rinsing water (6) has a relatively large volume, it may not be introduced directly into the roaster (3) and must be concentrated beforehand. An evaporator having an exhaust vapor seal is provided as the concentrator (12), since this type has the lowest energy consumption at approximately 25 kWh/$m^3$ distillate.

It is known that the acids ($HNO_3$, HF, and HCl) used for pickling metal are volatile in vapor. Therefore, avoiding free acids before evaporation must be attempted. According to the present invention, the free acids in the rinsing water stream (6) are converted into metal salts in a reactor (5) by adding a reagent (11). The reagent (11) is preferably a metal hydroxide of a species which also occurs in the pickling bath. Through this measure, significantly less acids are found in the distillate (7); however, the quality is typically insufficient to use it for rinsing purposes in the last rinsing stage. Use of the distillate (7) in preceding rinsing stages is possible, however.

A further reason for converting the free acids into metal salts in the reactor (5) is corrosion problems in the concentrator (12). The less free acids in the supply (**6*a***), the lower the corrosive attack on the stainless steels to be used. Less expensive stainless steels may be used in construction.

In order to achieve the desired VE rinsing quality (10) of the last rinsing stage, it is advantageous to provide an additional device (13). Since the material load in the drain (8) of the last rinsing stage is low, an ion exchange loop system (13) suggests itself for this purpose. The water losses of the last rinsing stage through overflow to the preceding rinsing stages may be compensated for by a VE water stream (9).

The stream (**6*a*) containing metal salts which is supplied to the concentrator (12) is concentrated as much as possible in order to keep the volume flow (15) to the roaster (3**) small.

In the roaster (3), the streams (2+15) are separated into acids and metal oxides through a thermal method. The volume stream (16) having the acids is returned into the pickling bath (1), and the metal oxides may be supplied to a melting procedure for further exploitation.

The supply volume (2) to the roaster (3) from the pickling bath (1) depends on the pickling capacity and metal concentration in the pickling bath. In the present case, a volume stream of approximately 3.5 $m^3$/hour is assumed, which maintains an iron content of approximately 35 g/l in the pickling bath (1). The iron content in the pickling bath (1) is not to rise further, since otherwise iron fluoride precipitates would occur in the pickling bath (1). The concentrate stream (15) of the evaporator, of approximately 0.5 $m^3$/hour, is added to this stream (2), so that the roaster (3) is preferably to be designed for a supply volume of 4.0 $m^3$/hour.

The energy consumption of the roaster (3) will be approximately 400 $m^3$/hour natural gas under these conditions, and that of the evaporator (12) will be approximately 375 kWh/hour. If the rinsing water stream (6) was introduced directly into the roaster (3), the energy consumption would rise to approximately 1,500 $m^3$/hour natural gas. The investment costs for the roaster (3) would be multiple times higher.

A cost effectiveness calculation of the variations of the method according to the present invention according to Examples 1 through 3 with recycling in comparison to a method without recycling is shown in Table 1.

Example 2

Example 2 shows a method optimized in relation to Example 1. As may be seen from Example 1, the free acids are an obstruction when recycling. Since the highest acid concentrations occur in the pickling bath concentrate of the pickle (1), in Example 2, a system (13) is provided to separate free acids and metal salts.

The volume stream (18) having the free acids is conducted back into the pickling bath (1), while a volume stream (19) having the metal salts is supplied to the reactor (5) for further treatment. Since the old acid stream (2) also contains mechanical impurities (scale) in this case, filtering (7) is necessary for the further treatment of the volume stream (2). The stream (8) which has been freed of mechanical impurities is introduced into the separating system (13).

An acid retardation system (13) is used to separate metal salts and acids. This system requires process water (20), on which no especially high quality requirements are placed. A partial stream of the accumulated rinsing water stream (6) is used to operate the system (13). This has the advantage that the volume stream (23) to the evaporator is reduced. The metal salt stream (19) is generated using the rinsing water stream (20). The metal salt stream (19) is low in acids and rich in metal salts.

The metal salt stream (19) is supplied together with the partial stream (21) from the filtration and the rinsing water stream (22) to a reactor (5). In this reactor (5), the remaining free acid in the metal salt is converted by an externally provided reagent (11) (see also Example 1).

The volume stream (23), which is as free of acid is possible, is supplied, as in Example 1, to a concentrator (12) and separated into a partial stream (15) having the metal salts and a partial stream (10) having the distillate and a residual quantity having free acid. The distillate (10) again does not have VE quality and may be supplied to an existing complete desalination system as untreated water. The untreated water (10) treated in the complete desalination system is subsequently fed back into the rinsing system as rinsing water (9).

Due to the very low content of free acid in the supply (23) to the concentrator (12), high concentration factors may be implemented in the concentrator (12). In this way, the volume stream (15) to the roaster (3) may be reduced in relation to Example 1 from approximately 4 $m^3$/hour to approximately 1 $m^3$/hour. This measure reduces the energy consumption in the roaster (3) in relation to Example 1 by approximately 300 $m^3$/hour of natural gas. The energy consumption of the concentrator (12) remains approximately equal in relation to Example 1.

Further advantages of the method according to Example 2 are the following:

The capacity (investment costs) of the roaster (3) may be reduced because of the reduced volume stream (15).

The exhaust gas losses of free acids of the roaster (3) is a percentage constant of the supply quantity (15). Only a partial quantity of acids still reaches the roaster (3) because of the recycling of the free acids in system (13), with correspondingly lower exhaust gas losses.

The cost effectiveness of this method is shown in Table 1.

Example 3

Example 3 shows a method optimized further in relation to Example 2. As in Example 2, in Example 3 as well the free acids from the pickling bath stream (2) are separated using a system (13) into a stream (18) having free acids and a stream (19) having metal salts. However, in Example 3 only this stream (23), which has a small volume, is supplied to a concentrator (12). The rinsing water stream (20), which has a large volume, is supplied to separate treatment in a system (24). In system (24), the metals are precipitated and filtered off by adding a neutralization chemical (KOH). The precipitated metals are transferred as metal hydroxides as the stream (11) into the reactor (5), in order to convert the free acids into metal salts here.

The waste water stream (26) generated during neutralization contains the neutral salts KOH and KF and is supplied to the concentrator (27). Since only neutral salts are present in the supply (26) to the concentrator (27), there is no longer any danger of vapor volatility of the acids during operation. The distillate (9) generated in the evaporator (27) has VE quality and may be introduced directly into the last rinse (4) as rinsing water. Additional treatment via an ion exchange system is no longer necessary. Furthermore, the now neutral supply (26) to the concentrator (27) permits typical stainless steels for this construction, which leads to cost savings in the investments.

The concentrate (28) made of KF and $KNO_3$, which is generated by the evaporator (27), is supplied to an electrolysis cell (29), in which the salts are decomposed into acids and basis. The base stream (25) is used again in neutralization (24) and the acids (30) are used again in the pickling bath (1).

While the energy consumption in Examples 2 and 3 is comparable, advantages in investment costs result for Example 3, which may be described as follows:

In Example 2 both volume streams (2/8/19) and (6/22) go via the concentrator (12) in a magnitude of approximately 15 $m^3$/hour. Since the pH value of the supply (23) to the concentrator (12) is not neutral, but rather acid, high-value stainless steels are required for construction, which increases the investment costs.

In Example 3, only the volume stream (2/8/19), at a magnitude of approximately 3.5 $m^3$/hour, is introduced into the concentrator (12). Although this concentrator must be constructed in high-value stainless steels, the investment costs are reduced since it may be constructed significantly smaller.

As in Example 2, the concentrator (12) generates a slightly acid distillate (10). However, this water may be used as process water for the separating system (13) without anything further and does not need to be additionally treated.

Furthermore, due to the neutralization of the rinsing water stream (20), the concentrator (27) in the system (24) may be manufactured from commercial quality stainless steels. This particularly lowers the investment costs, since the concentrator (27), at approximately 15 $m^2$/hour, is multiple times larger than the concentrator (12).

Furthermore, the distillate from concentrator (27) has VE quality and does not need to be treated again via an ion exchanger.

The metal hydroxide (11) generated in the neutralization (24) is consumed to convert the free acid in the reactor (5). The reactor (5) is therefore freed from external supply by the reagent (11) in Example 2.

Through the separate rinsing water treatment (20), the supply volume to the roaster (3) may be reduced slightly once again. While the supply volume (15) in Example 2 still makes up approximately 1 $m^3$/hour, it is reduced in Example 3 to approximately 0.83 ms/hour. The energy consumption of the roaster (3) is correspondingly lower.

TABLE 1

Cost effectiveness comparison of the examples

| | Investments (million €) | Operating costs (million €/year) | Savings (million €/year) | Payback (years) |
|---|---|---|---|---|
| Without recycling | 0 | 4.4 | 0 | >> |
| Example 1 | 9.0 | 0.7 | 3.7 | 2.4 |
| Example 2 | 8.0 | 0.4 | 4.0 | 2.0 |
| Example 3 | 7.0 | 0.3 | 4.1 | 1.7 |

The invention claimed is:

1. A method for recycling stainless steel pickling baths, including the associated rinsing baths and air washers, having the following steps:

a) converting the free acids present in the liquid waste streams to be treated into the metal salt form before recycling, b) separating water from the largely acid-free metal salt solution obtained in order to obtain a concentrated metal salt solution, and c) supplying the concentrated metal salt solution to a thermal method to obtain metal oxides and free acids, and d) separating the waste stream from the pickling baths to be recycled in a suitable separating system into a first partial stream having the metal salts to be recycled and a second partial stream having free acids, wherein the second partial stream is conducted from the separating system back into the pickling bath, while the first partial stream is collected for further treatment according to steps a) to c), wherein the residues of free acids existing in the first partial stream are converted into metal salts according to step a) using metal hydroxides, oxides, or carbonates of the metals used in the pickling bath, wherein the first partial stream is mixed before step a) with the acid waste stream from the rinsing baths/air washers, wherein the treated first partial stream having metal salts is converted in a system for separating water, according to step b), into a concentrated metal salt solution near the solubility limit of the metal salts.

2. The method according to claim 1, wherein the acid waste streams from the pickling baths and the rinsing baths/air washers are each subjected to a separate treatment.

3. The method according to claim 1, wherein the separated water is returned into the method for reuse.

4. The method according to claim 1, wherein the water separated in step b) is returned to the separating system as process water in the form of a slightly acidic distillate.

5. The method according to claim 1, wherein the concentrated metal salt solution from the pickling baths and possibly the rinsing baths and air washers is supplied to a thermal method for decomposing the salts into metal oxides and free acids according to step c).

6. The method according to claim 1, wherein the rinsing water and/or the waste water of the rinsing baths/air washers are neutralized using a chemical, particularly sodium hydroxide solution or potassium hydroxide solution, through which the acid residues are left in dissolved form, but the metals are precipitated.

7. The method according to claim 6, wherein the precipitated and filtered metal salts are supplied to step a), particularly as metal hydroxides, for converting the free acid into metal salts.

8. The method according to claim 6, wherein the neutralized waste water is converted in a system for separating water into a concentrated salt solution near the solubility limit of the metal salt and the distillate generated is used again for rinsing purposes.

9. The method according to claim 6, wherein the concentrated salt solution is converted in a system for salt decomposition, particularly a cationic exchanger or electrodialysis system, into acids and bases for reuse in the process.

10. The method according to claim 1, wherein a steel pickling bath is used as the metal pickling bath.

11. The method according to claim 10, wherein a stainless steel pickling bath is used as the steel pickling bath.

12. A method for recycling stainless steel pickling baths, including the associated rinsing baths and air washers, having the following steps:

separating a pickling waste stream from the pickling baths to be recycled in a suitable separating system into a first partial stream having the metal salts to be recycled and a second partial stream having free acids, wherein the second partial stream is conducted from the separating system back into the pickling bath, while the first partial stream is collected for further treatment;

converting the free acids present in the first partial stream into metal salt form before recycling, wherein residues of free acids existing in the first partial stream are converted into metal salts by using metal hydroxides, oxides or carbonates of the metals used in the pickling bath, wherein a largely acid free-metal salt solution is obtained from the first partial stream;

separating water from the largely acid-free metal salt solution in order to obtain a concentrated metal salt solution near the solubility limit of the metal salts, the concentrated metal salt solution being obtained by converting the largely acid-free metal salt solution in a system for separating water; and supplying the concentrated metal salt solution and an acid waste stream from the rinsing baths/air washers to a thermal method to obtain metal oxides and free acids, wherein the first partial stream from the separating system and the acid waste stream from the rinsing baths/air washers are each subjected to a separate treatment before being supplied to the thermal method.

* * * * *